US011206480B2

(12) United States Patent
Lim et al.

(10) Patent No.: US 11,206,480 B2
(45) Date of Patent: Dec. 21, 2021

(54) OPEN-AIR TYPE EARPHONE WITH BRACKET FORMING BASS PIPE

(71) Applicant: EM-TECH Co., Ltd., Gyeongsangnam-do (KR)

(72) Inventors: Dong Wook Lim, Gyeonggi-do (KR); Chang Hwa Jeong, Gyeonggi-do (KR)

(73) Assignee: EM-TECH CO., LTD., Gyeongsangnam-do (KR)

( * ) Notice: Subject to any disclaimer, the term of this patent is extended or adjusted under 35 U.S.C. 154(b) by 0 days.

(21) Appl. No.: 16/793,070

(22) Filed: Feb. 18, 2020

(65) Prior Publication Data

US 2021/0058699 A1 Feb. 25, 2021

(30) Foreign Application Priority Data

Aug. 19, 2019 (KR) ..... 10-2019-0100955

(51) Int. Cl.
*H04R 1/28* (2006.01)
*H04R 1/10* (2006.01)

(52) U.S. Cl.
CPC ..... *H04R 1/2826* (2013.01); *H04R 1/1016* (2013.01); *H04R 1/1075* (2013.01); *H04R 2460/11* (2013.01)

(58) Field of Classification Search
CPC .. H04R 1/2826; H04R 1/1016; H04R 1/1075; H04R 2460/11
See application file for complete search history.

(56) References Cited

U.S. PATENT DOCUMENTS

| | | | | |
|---|---|---|---|---|
| 4,742,887 | A | 5/1988 | Yamagishi | |
| 9,578,412 | B2 * | 2/2017 | Azmi | H04R 1/2826 |
| 2008/0298623 | A1 * | 12/2008 | Klein | H04R 1/2857 381/380 |
| 2020/0145749 | A1 * | 5/2020 | Hu | H04R 1/1016 |

FOREIGN PATENT DOCUMENTS

| | | | |
|---|---|---|---|
| KR | 100694160 | B1 | 3/2007 |
| KR | 20180020619 | A | 2/2018 |
| KR | 101956880 | B1 | 3/2019 |

* cited by examiner

*Primary Examiner* — Brian Ensey
(74) *Attorney, Agent, or Firm* — Murphy, Bilak & Homilier, PLLC

(57) ABSTRACT

An open-air type earphone with a bracket forming a bass pipe is provided. The open-air type earphone includes: a housing configured to be worn on an ear and having a sound-emitting hole and a back hole; an acoustic transducer mounted within the housing and configured to emit sound to the sound-emitting hole; and one or more brackets mounted between the acoustic transducer and the housing and capable of tuning acoustic characteristics.

7 Claims, 5 Drawing Sheets

OPEN-AIR TYPE EARPHONE WITH BRACKET FORMING BASS PIPE

TECHNICAL FIELD

The present invention relates to earphones, and more particularly, to an open-air type earphone with a bracket forming a bass pipe.

BACKGROUND

Earphones can be classified as a closed-air type earphone and an open-air type earphone according to the shape of a housing in which an acoustic transducer is contained. Closed-air type earphones are configured such that a housing is hermetically closed from the surrounding atmosphere, and open-air type earphones are configured such that small back holes are formed along an edge of a rear portion of a housing to communicate between the inside and the outside of the housing.

In closed-air type earphones, since the sound pressure in the ear changes according to how tight the earphone fits into the ear, the sound quality for listening can also vary. However, in the open-air type earphones, since the inside and the outside of a housing communicate with each other, the sound pressure inside the ear can be kept constant over a wide range of frequencies from low to high frequencies. Additionally, acoustic resistance materials, e.g., urethane foams, may be embedded in back holes formed in the housing of the open-air type earphones to prevent external noise from getting mixed in.

Resonance in the open-air type earphone occurs at a frequency between a middle frequency and high frequency of an acoustic signal according to the size of the back holes. This resonance results in a sound pressure peak between the middle frequency and the high frequency, thereby degrading frequency characteristics of the open-air type earphones. In an effort to address these problems, an open-air type earphone having a duct was developed. Such an open-air type earphone having a duct is disclosed in U.S. Laid-Open U.S. Pat. No. 4,742,887.

However, when forming the duct, the housing of the earphone requires an elongated portion, as well as an earbud portion that is inserted into the ear, which is a drawback in terms of design. Another drawback is the increase in the overall size of the earphone caused by the presence of a duct space.

SUMMARY

An object of the present invention is to provide an open-air type earphone with a bracket forming a bass pipe, which can tune sound pressure to be flat at mid frequencies and increase sound pressure at high frequencies by including a bracket, instead of a duct, in an earbud to form a bass pipe.

According to an aspect of the present invention for achieving the above objects, there is provided an open-air type earphone with a bracket forming a bass pipe, the open-air type earphone comprising: a housing that is worn on an ear and has a sound-emitting hole and a back hole; an acoustic transducer that is mounted within the housing and emits sound to the sound-emitting hole; and one or more brackets that are mounted between the acoustic transducer and the housing and capable of tuning acoustic characteristics.

In some embodiments, two or more sound-emitting holes may be formed in the housing, and a first bracket with two bass pipes for directing sound to the sound-emitting holes may be mounted between the sound-emitting holes and the acoustic transducer.

In some embodiments, the bass pipes and the sound-emitting holes may be spaced apart from each other, and the first bracket may have recessed portions to form a resonant space between the bass pipes and the sound-emitting holes.

In some embodiments, two sound-emitting holes may be formed in the first bracket, and the sound emission angle of each sound-emitting hole may be equal to or greater than 90 degrees.

In some embodiments, a second bracket with a bass pipe for directing air to flow into and out of the back hole may be mounted between the back hole and the acoustic transducer.

In some embodiments, the second bracket may have a communicating hole that is spaced apart from the back hole and communicates with the inside of the housing, and the bass pipe may connect the communicating hole and the back hole An open-air type earphone with a bracket forming a bass pipe according to the present invention offers the advantages of widening the allowable design range of the open-air type earphone and reducing the volume, by including a bass pipe for sound tuning in a bracket mounted within an earbud, without having an extended bass pipe in the housing.

Those skilled in the art will recognize additional features and advantages upon reading the following detailed description, and upon viewing the accompanying drawings.

DETAILED DESCRIPTION

Figure 1:
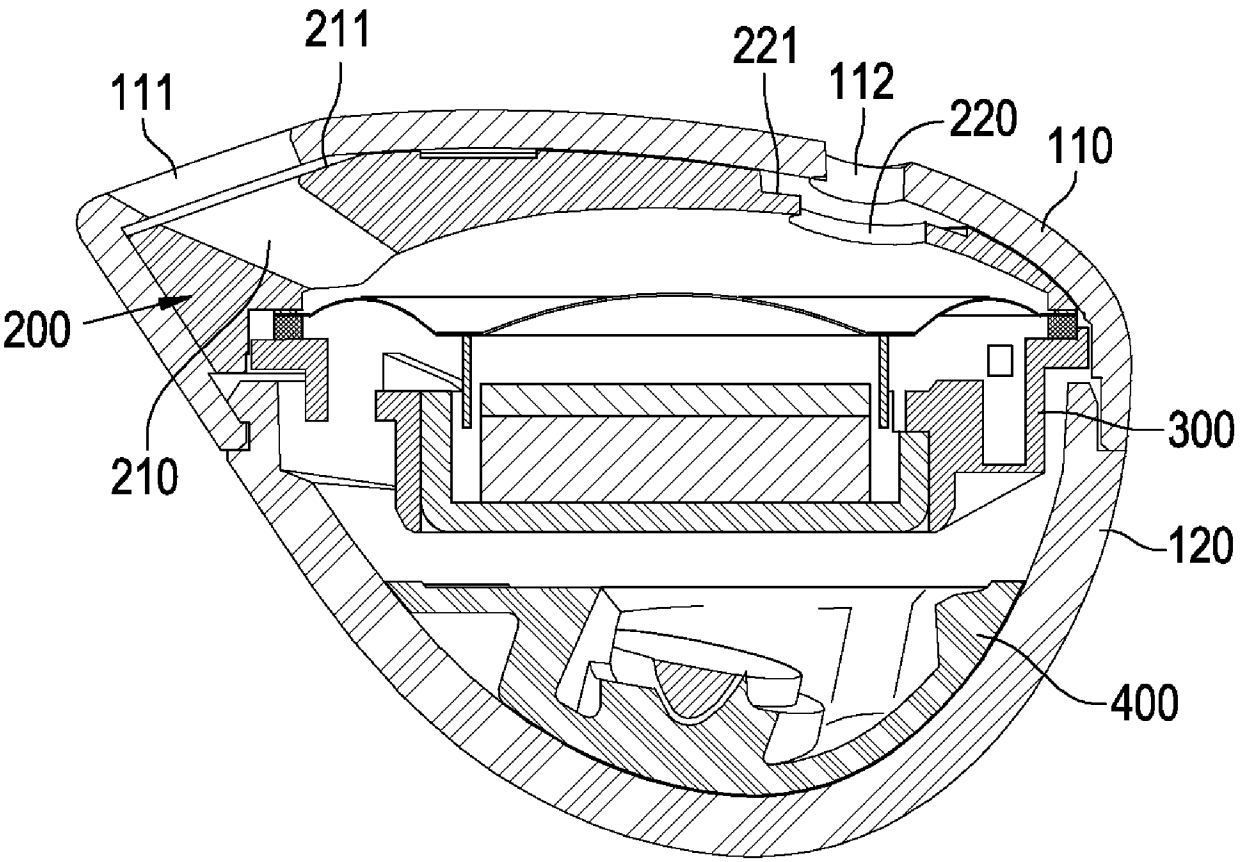
FIG. 1 is a cross-sectional view of an open-air type earphone with a bracket forming a bass pipe according to an exemplary embodiment of the present invention.

FIG. 1 is a cross-sectional view of an open-air type earphone with a bracket forming a bass pipe according to an exemplary embodiment of the present invention.

The open-air type earphone with a bracket forming a bass pipe according to an exemplary embodiment of the present invention includes housings 110 and 120 that can be inserted into an external auditory canal. The housings 110 and 120 include a first housing 110 and a second housing 120. The first housing faces a user's ear and has sound-emitting holes 111 and 112 through which sound is emitted to the user's ear. The second housing 120 faces outward and has a back hole through which air flows.

An acoustic transducer 300 is mounted in the housings 110 and 120, and, the earphone, if it is a wireless earphone capable of wireless communication, may further include electrical components such as a controller panel (not shown), a Bluetooth module (not shown), a battery (not shown), and so on.

The acoustic transducer 300 is mounted in such a way that a sound-emitting surface, i.e., a surface where a vibrating plate is positioned, faces the first housing 110.

The first housing 110 includes two sound-emitting holes 111 and 112. In this case, the first sound-emitting hole 111 of a smaller size and the second sound-emitting hole 112 of a larger size may be spaced apart from each other. A first bracket 200 is mounted between the first housing 110 and the acoustic transducer 300. The first bracket 200 includes a first bass pipe 210 for communicating between the first sound-emitting hole 111 and the acoustic transducer 300 and a second bass pipe 220 for communicating between the second sound-emitting hole 112 and the acoustic transducer 300. Preferably, the first bass pipe 210 is relatively longer than the second bass pipe 220.

Meanwhile, the bass pipes 210 and 220 and the sound-emitting holes 111 and 112 may be spaced apart from each other, and the first bracket 200 may have recessed portions 211 and 221 to form a resonant space between the bass pipes 210 and 220 and the sound-emitting holes 111 and 112. Preferably, the first recessed portion 211 positioned at an end of the first bass pipe 210 is deeper than the second recessed portion 221 positioned at an end of the second bass pipe 220.

The first sound-emitting hole 111 emits sound to the external auditory canal from the acoustic transducer 300, and the second sound-emitting hole 112 has a structure for achieving the overall balance of SPL and serves to tune sound pressure to be flat at mid frequencies and increase sound pressure at high frequencies.

Preferably, the sound emission angle of the first sound-emitting hole 111 and the sound emission angle of the second sound-emitting hole 112 are equal to or greater than 90 degrees.

Figure 2:
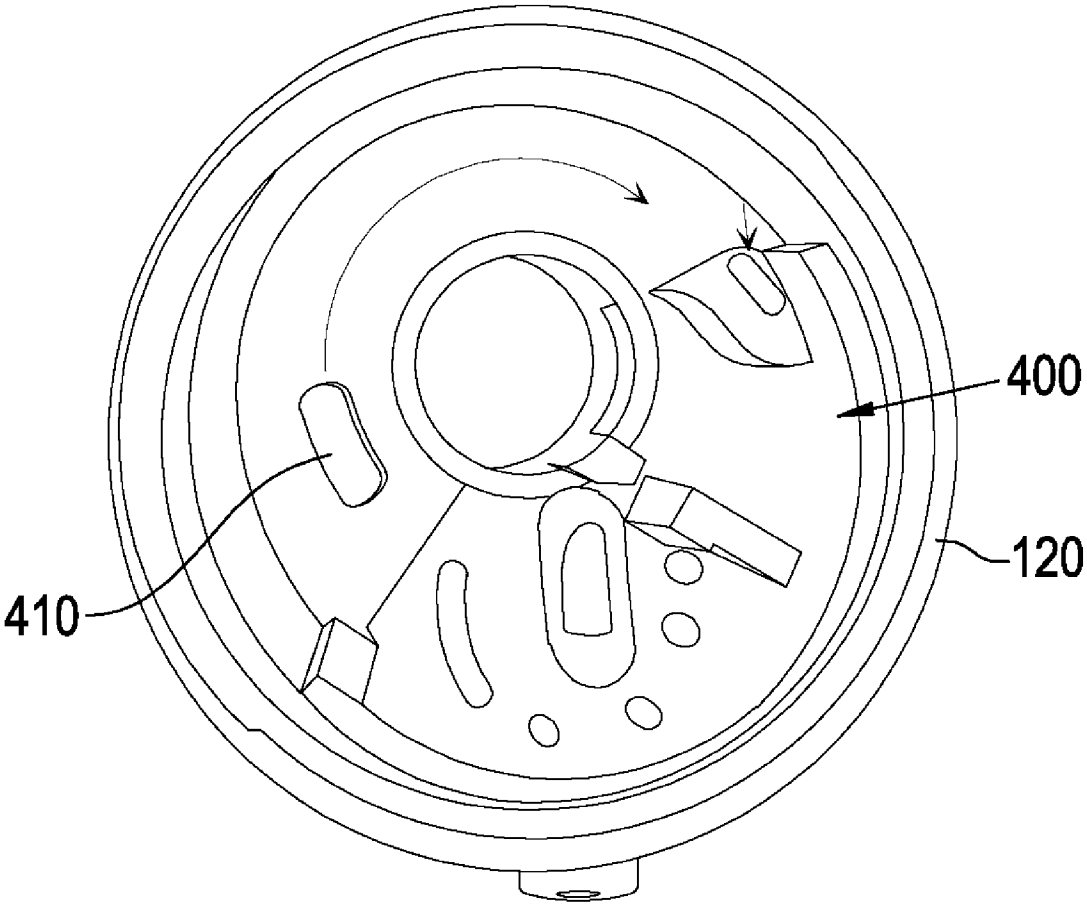
FIG. 2 is a view of how a second bracket is mounted, in an open-air type with a bracket forming a bass pipe according to an exemplary embodiment of the present invention, when viewed from the second bracket.

FIG. 2 is a view of how a second bracket is mounted, in an open-air type with a bracket forming a bass pipe according to an exemplary embodiment of the present invention, when viewed from the second bracket.

Figure 3:
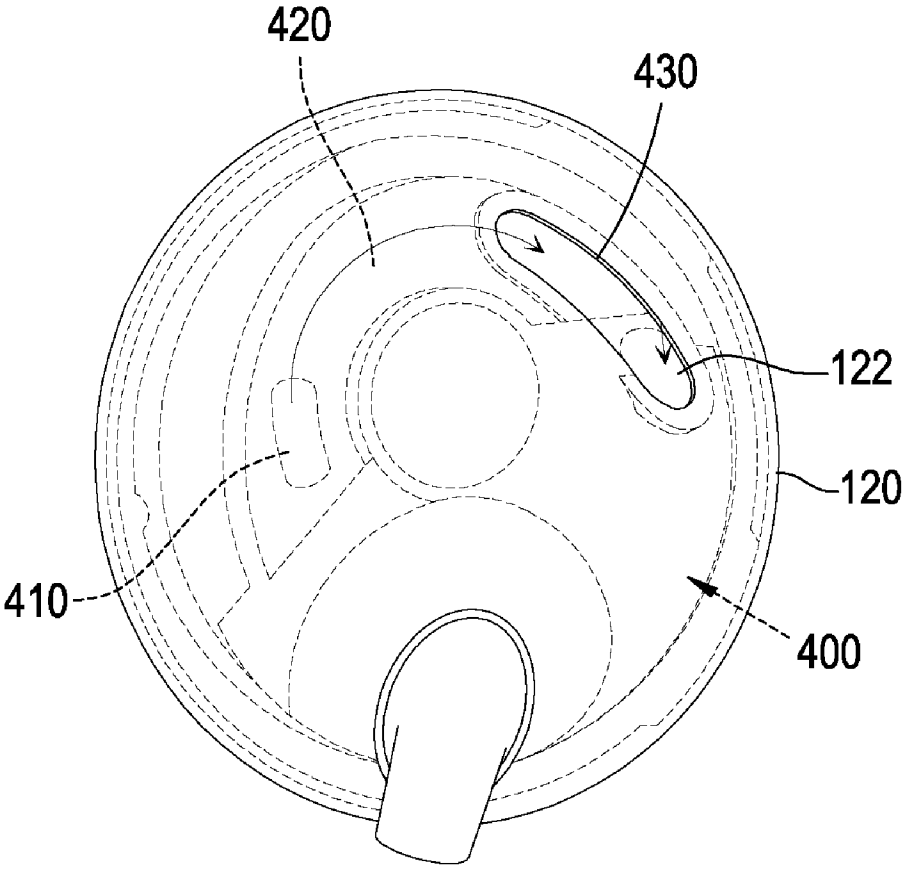
FIG. 3 is a view of how a second bracket is mounted, in an open-air type with a bracket forming a bass pipe according to an exemplary embodiment of the present invention, when viewed from the housing.

FIG. 3 is a view of how a second bracket is mounted, in an open-air type with a bracket forming a bass pipe according to an exemplary embodiment of the present invention, when viewed from the housing.

A second bracket 400 is mounted between the second housing 120 and the acoustic transducer 300 (see FIG. 1). The second housing 120 has a back hole 122 for communicating between the inside and outside of the housing so as to keep the sound pressure inside the ear constant. The second bracket 400 forms a bass pipe 420 by covering the back hole 122. The second bracket 400 has a communicating hole 410 that is spaced apart from the back hole 122 and communicates between the inside of the housing and the bass pipe 420. That is, the bass pipe 420 connects the communicating hole 410 and the back hole 122. Also, a screen 430 or the like may be fitted around the back hole 122 to prevent foreign materials from entering from the outside.

Figure 4:
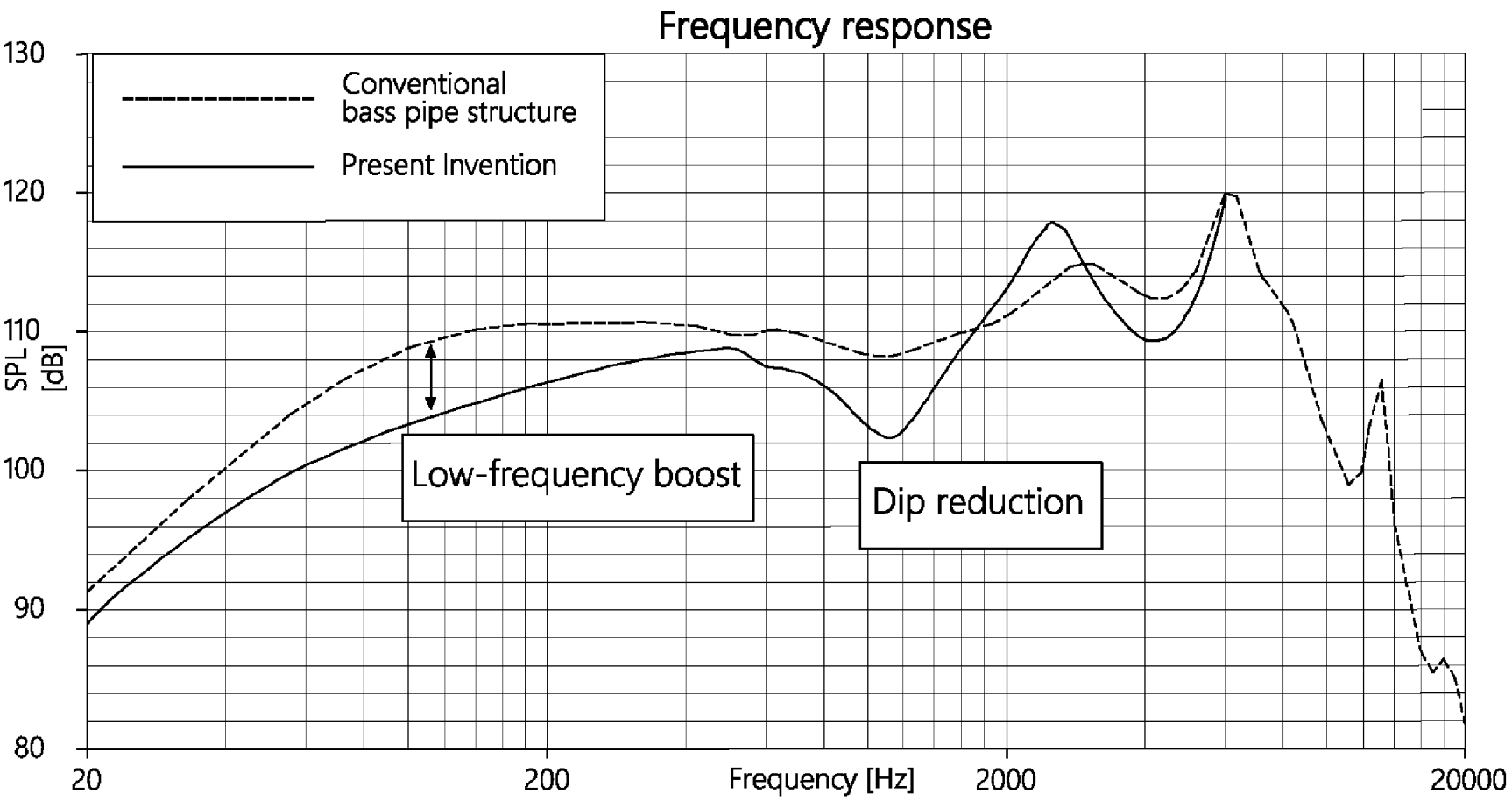
FIG. 4 is a graph of sound pressure level versus frequency showing a comparison between an open-air type earphone with a bracket forming a bass pipe according to an exemplary embodiment of the present invention and an open-air type earphone with no bracket forming a bass pipe.

FIG. 4 is a graph of sound pressure level versus frequency showing a comparison between an open-air type earphone with a bracket forming a bass pipe according to an exemplary embodiment of the present invention and an open-air type earphone with no bracket forming a bass pipe.

As shown in the graph, a bass pipe structure formed by the brackets 200 and 400 serves to create an internal resonance within the housing and intensify low-frequency sounds. Moreover, the back hole 122 serves to reduce a dip in the 2 kHz range.

Figure 5:
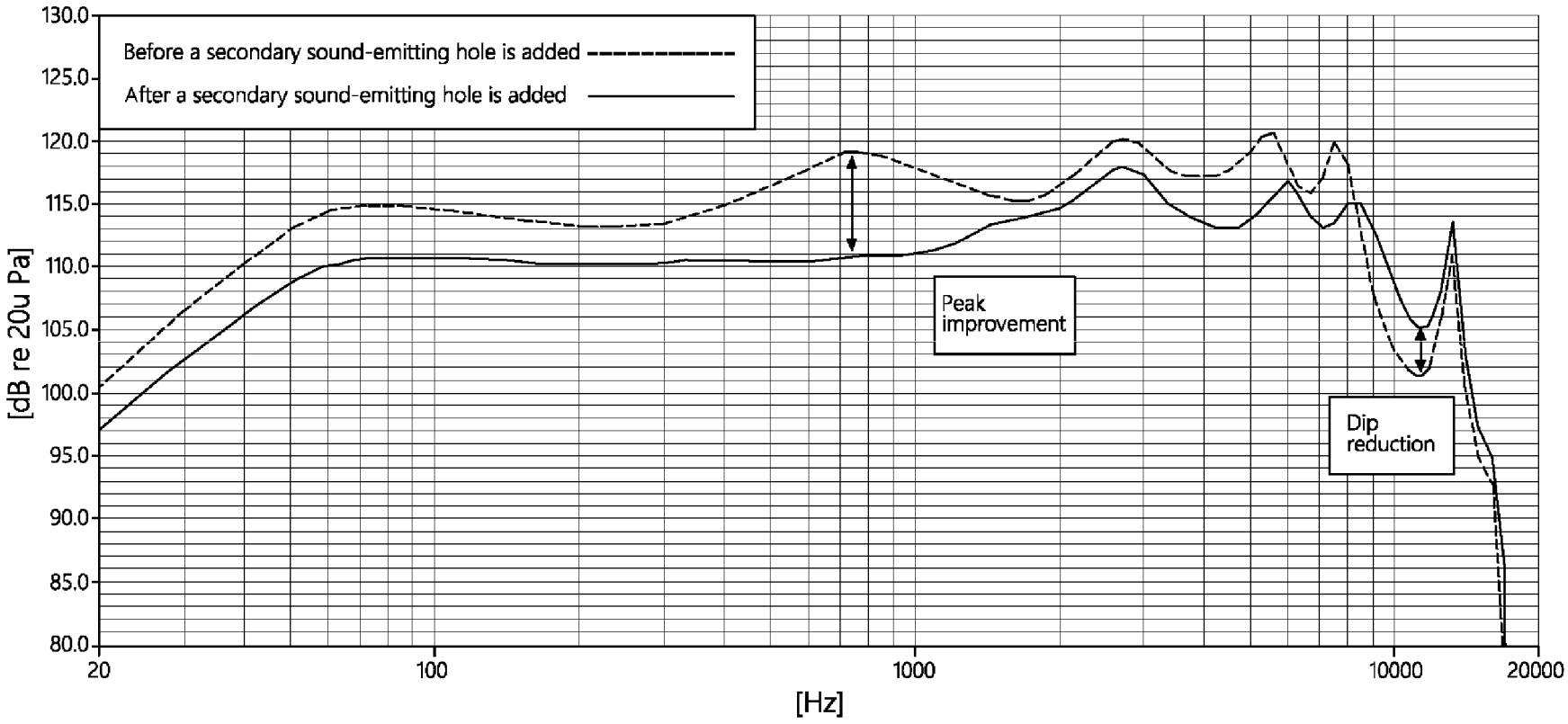
FIG. 5 is a graph of sound pressure level versus frequency showing a comparison between when an open-air type earphone with a bracket forming a bass pipe according to an exemplary embodiment of the present invention has one sound-emitting hole and when it has two sound-emitting holes.

FIG. 5 is a graph of sound pressure level versus frequency showing a comparison between when an open-air type earphone with a bracket forming a bass pipe according to an exemplary embodiment of the present invention has one sound-emitting hole and when it has two sound-emitting holes.

It was observed that sound pressure was tuned flat across all sound frequencies when there are two sound-emitting holes, compared to when there is one sound-emitting hole, and that the dip at 10 kHz or above was also significantly reduced.

Terms such as "first", "second", and the like, are used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

It is to be understood that the features of the various embodiments described herein may be combined with each other, unless specifically noted otherwise.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An open-air type earphone with a bracket forming a bass pipe, the open-air type earphone comprising:
   - a housing configured to be worn on an ear and having a first sound-emitting hole and a second sound-emitting hole which face the ear when the housing is worn on the ear and through which sound is configured to be emitted to the ear, and a back hole which faces outward and through which air flows;
   - an acoustic transducer mounted within the housing and configured to emit sound to the first sound-emitting hole and the second sound-emitting hole; and
   - a first bracket mounted between the acoustic transducer and the housing, the first bracket having a first bass pipe configured to direct sound to the first sound-emitting hole and a second bass pipe configured to direct sound to the second-emitting hole and capable of tuning acoustic characteristics.

2. The open-air type earphone of claim 1, wherein the first and second bass pipes and the first and second sound-emitting holes are spaced apart from each other, and wherein the first bracket has recessed portions which form a resonant space between the first and second bass pipes and the first and second sound-emitting holes.

3. The open-air type earphone of claim 1, wherein a sound emission angle between the first sound-emitting hole formed and the second sound-emitting hole in the first bracket is equal to or greater than 90 degrees.

4. The open-air type earphone of claim 1, wherein a second bracket with a third bass pipe configured to direct air to flow into and out of the back hole is mounted between the back hole and the acoustic transducer.

5. The open-air type earphone of claim 4, wherein the second bracket has a communicating hole that is spaced apart from the back hole and communicates with an inside of the housing, and wherein the third bass pipe connects the communicating hole and the back hole.

6. The open-air type earphone of claim 1, wherein a size of the first sound-emitting hole is smaller than a size of the second sound-emitting hole, and wherein the first bass pipe is longer than the second bass pipe.

7. The open-air type earphone of claim 2, wherein a first recessed portion positioned at an end of the first bass pipe is deeper than a second recessed portion positioned at an end of the second bass pipe.

* * * * *